US005709278A

United States Patent [19]

Crawford

[11] Patent Number: 5,709,278

[45] Date of Patent: Jan. 20, 1998

[54] ROTARY CONE DRILL BIT WITH CONTOURED INSERTS AND COMPACTS

[75] Inventor: Michael Burl Crawford, Duncanville, Tex.

[73] Assignee: Dresser Industries, Inc., Dallas, Tex.

[21] Appl. No.: 589,815

[22] Filed: Jan. 22, 1996

[51] Int. Cl.[6] ..... E21B 10/46

[52] U.S. Cl. ..... 175/374; 175/426

[58] Field of Search ..... 175/331, 374, 175/420.1, 426

[56] References Cited

U.S. PATENT DOCUMENTS

| | | | |
|---|---|---|---|
| Re. 32,036 | 11/1985 | Dennis | 175/329 |
| 1,306,674 | 6/1919 | Esseling . | |
| 1,996,322 | 4/1935 | Carlson | 255/72 |
| 2,014,806 | 9/1935 | Howard et al. | 255/72 |
| 2,027,700 | 1/1936 | Rogatz | 255/71 |
| 2,081,195 | 5/1937 | Catland et al. | 255/72 |
| 2,103,611 | 12/1937 | Catland et al. | 255/72 |
| 2,117,481 | 5/1938 | Howard | 255/72 |
| 2,121,202 | 6/1938 | Killgore | 255/71 |
| 2,123,453 | 7/1938 | Catland et al. | 255/72 |
| 2,358,642 | 8/1944 | Kammerer | 255/71 |
| 2,412,915 | 12/1946 | Sewell | 255/72 |
| 2,470,695 | 5/1949 | Goodwin et al. | 255/71 |
| 2,514,586 | 7/1950 | Natland et al. | 255/72 |
| 2,661,931 | 12/1953 | Swart | 255/302 |
| 2,667,334 | 1/1954 | Ortloff | 255/71 |
| 2,774,571 | 12/1956 | Morian | 255/347 |
| 2,804,282 | 8/1957 | Spengler, Jr. | 255/345 |
| 2,893,696 | 7/1959 | McGuire | 255/72 |
| 2,901,223 | 8/1959 | Scott | 255/302 |
| 3,075,592 | 1/1963 | Overly et al. | 175/333 |
| 3,091,300 | 5/1963 | Hammer | 175/333 |
| 3,095,053 | 6/1963 | Pistole et al. | 175/329 |
| 3,100,544 | 8/1963 | Overly et al. | 175/333 |
| 3,126,067 | 3/1964 | Schumacher, Jr. | 175/374 |
| 3,134,447 | 5/1964 | McElya et al. | 175/332 |
| 3,137,355 | 6/1964 | Schumacher, Jr. | 175/374 |
| 3,174,564 | 3/1965 | Morlan | 175/330 |
| 3,250,337 | 5/1966 | Demo | 175/343 |
| 3,311,181 | 3/1967 | Fowler | 175/410 |
| 3,389,761 | 6/1968 | Ott | 175/374 |
| 3,461,983 | 8/1969 | Hudson et al. | 175/375 |
| 3,739,864 | 6/1973 | Cason | 175/228 |
| 3,858,671 | 1/1975 | Kita et al. | 175/410 |
| 3,922,038 | 11/1975 | Seales | 308/8.2 |
| 3,948,330 | 4/1976 | Langford, Jr. | 175/339 |
| 3,952,815 | 4/1976 | Dysart | 175/374 |

(List continued on next page.)

FOREIGN PATENT DOCUMENTS

| | | |
|---|---|---|
| 0140849 | 8/1985 | European Pat. Off. . |
| 2019921 | 3/1979 | United Kingdom . |

OTHER PUBLICATIONS

"Kor King" Diamant Boart Stratabit, 1988.

"readily available fluid . . . " (no date).

"PDC Bits Matrix", Security DBS, pp. 32–39 (no date).

MEGAdiamond, *Megadiamond Announces a Unique Service,* dated Oct. 6, 1981 (4 pp.).

*Primary Examiner*—William P. Neuder

*Attorney, Agent, or Firm*—Baker & Botts, L.L.P.

[57] ABSTRACT

A rotary cone drill bit (20 and 120)is provided with inserts (70 and 90) and compacts (50 and 150) having contoured cutting portions (66, 166, 72 and 92). The rotary cone drill bit (22 and 122) includes a bit body (26 and 126) having at least one downwardly extending arm (28) terminating in a spindle (40). A cutter cone (30) with a gauge face surface (62) and a plurality of holes (64) formed therein, is rotatably mounted on each spindle (40). A compact (50 and 150) having a cutting portion (66 and 166) with a radius approximately equal to the desired radius for the resulting borehole (100) is press fit into each hole (64) in the gauge face surface (62). A number of inserts (70 and 90) are also installed in the exterior of each support arm (28). Inserts (70 and 90) have a contoured cutting surface with a radius approximately equal to the desired radius for the resulting borehole (100). The contoured cutting portion on both the compacts (50 and 150) and the inserts (70 and 90) may be either domed shaped or cylindrically shaped.

22 Claims, 4 Drawing Sheets

U.S. PATENT DOCUMENTS

| | | | |
|---|---|---|---|
| 4,006,788 | 2/1977 | Garner | 175/330 |
| 4,014,395 | 3/1977 | Pearson | 175/410 |
| 4,056,153 | 11/1977 | Migleirini | 175/376 |
| 4,058,177 | 11/1977 | Langford, Jr. et al. | 175/374 |
| 4,092,054 | 5/1978 | Dye | 308/8.2 |
| 4,098,358 | 7/1978 | Klima | 175/65 |
| 4,102,419 | 7/1978 | Klima | 175/371 |
| 4,109,737 | 8/1978 | Bovenkerk | 175/329 |
| 4,140,189 | 2/1979 | Garner | 175/329 |
| 4,148,368 | 4/1979 | Evans | 175/329 |
| 4,156,329 | 5/1979 | Daniels et al. | 51/295 |
| 4,158,394 | 6/1979 | Ernst et al. | 175/228 |
| 4,176,848 | 12/1979 | Lafuze | 277/92 |
| 4,179,003 | 12/1979 | Cooper et al. | 175/371 |
| 4,183,416 | 1/1980 | Walters | 175/229 |
| 4,183,417 | 1/1980 | Levefelt | 175/339 |
| 4,199,856 | 4/1980 | Farrow et al. | 29/454 |
| 4,203,496 | 5/1980 | Baker, III et al. | 175/329 |
| 4,225,144 | 9/1980 | Zitz et al. | 277/12 |
| 4,249,622 | 2/1981 | Dysart | 175/227 |
| 4,253,710 | 3/1981 | Goodman | 308/8.2 |
| 4,256,193 | 3/1981 | Kunkel et al. | 175/371 |
| 4,258,806 | 3/1981 | Kunkel et al. | 175/370 |
| 4,260,203 | 4/1981 | Garner | 308/8.2 |
| 4,265,324 | 5/1981 | Morris et al. | 175/329 |
| 4,272,134 | 6/1981 | Levefelt | 308/8.2 |
| 4,279,450 | 7/1981 | Morris | 308/8.2 |
| 4,284,310 | 8/1981 | Olschewski et al. | 308/8.2 |
| 4,285,409 | 8/1981 | Allen | 175/336 |
| 4,287,957 | 9/1981 | Evans | 175/17 |
| 4,298,079 | 11/1981 | Norlander et al. | 175/339 |
| 4,301,877 | 11/1981 | Cloud | 175/340 |
| 4,343,371 | 8/1982 | Baker, III et al. | 175/329 |
| 4,359,335 | 11/1982 | Garner | 75/208 R |
| 4,375,242 | 3/1983 | Galle | 175/228 |
| 4,386,668 | 6/1983 | Parish | 175/228 |
| 4,386,669 | 6/1983 | Evans | 175/269 |
| 4,421,184 | 12/1983 | Mullins | 175/337 |
| 4,442,909 | 4/1984 | Radtke | 175/329 |
| 4,444,281 | 4/1984 | Schumacher, Jr. et al. | 175/336 |
| 4,453,836 | 6/1984 | Klima | 384/94 |
| 4,512,426 | 4/1985 | Bidegaray | 175/329 |
| 4,515,228 | 5/1985 | Dolezal et al. | 175/313 |
| 4,527,644 | 7/1985 | Allan | 175/333 |
| 4,531,595 | 7/1985 | Housman | 175/329 |
| 4,533,003 | 8/1985 | Bailey et al. | 175/269 |
| 4,540,596 | 9/1985 | Nimmagadda | 427/37 |
| 4,545,441 | 10/1985 | Williamson | 175/329 |
| 4,552,232 | 11/1985 | Frear | 175/337 |
| 4,591,008 | 5/1986 | Oliver | 175/227 |
| 4,592,433 | 6/1986 | Dennis | 175/329 |
| 4,593,775 | 6/1986 | Chaney et al. | 175/228 |
| 4,595,067 | 6/1986 | Drake | 175/331 |
| 4,597,455 | 7/1986 | Walters et al. | 175/228 |
| 4,602,691 | 7/1986 | Weaver | 175/329 |
| 4,608,226 | 8/1986 | Lauvinerie et al. | 419/5 |
| 4,610,319 | 9/1986 | Kalsi | 175/371 |
| 4,610,452 | 9/1986 | DiRienz | 277/83 |
| 4,624,329 | 11/1986 | Evans et al. | 175/374 |
| 4,629,338 | 12/1986 | Ippolito | 384/94 |
| 4,688,651 | 8/1987 | Dysart | 175/371 |
| 4,690,228 | 9/1987 | Voelz et al. | 175/24 |
| 4,694,918 | 9/1987 | Hall | 175/329 |
| 4,705,124 | 11/1987 | Abrahamson | 175/410 |
| 4,722,405 | 2/1988 | Langford, Jr. | 175/374 |
| 4,724,913 | 2/1988 | Morris | 175/329 |
| 4,729,440 | 3/1988 | Hall | 175/107 |
| 4,738,322 | 4/1988 | Hall et al. | 175/329 |
| 4,744,427 | 5/1988 | Grappendorf | 175/329 |
| 4,784,023 | 11/1988 | Dennis | 76/108 A |
| 4,802,539 | 2/1989 | Hall et al. | 175/329 |
| 4,813,502 | 3/1989 | Dysart | 175/337 |
| 4,832,139 | 5/1989 | Minikus et al. | 175/374 |
| 4,865,136 | 9/1989 | White | 175/227 |
| 4,926,950 | 5/1990 | Zijsling | 175/39 |
| 4,928,777 | 5/1990 | Shirley-Fisher | 175/329 |
| 4,940,099 | 7/1990 | Deane et al. | 175/374 |
| 4,942,930 | 7/1990 | Millsapps, Jr. | 175/228 |
| 4,967,854 | 11/1990 | Barnetche-Gonzalez | 175/353 |
| 4,976,324 | 12/1990 | Tibbitts | 175/329 |
| 4,981,182 | 1/1991 | Dysart | 175/71 |
| 4,984,643 | 1/1991 | Isbell et al. | 175/341 |
| 4,997,049 | 3/1991 | Tank et al. | 175/410 |
| 5,025,874 | 6/1991 | Barr et al. | 175/329 |
| 5,027,911 | 7/1991 | Dysart | 175/57 |
| 5,074,367 | 12/1991 | Estes | 175/374 |
| 5,080,183 | 1/1992 | Schumacher et al. | 175/371 |
| 5,131,480 | 7/1992 | Lockstedt et al. | 175/374 |
| 5,145,016 | 9/1992 | Estes | 175/374 X |
| 5,154,245 | 10/1992 | Waldenstrom et al. | 175/420.2 |
| 5,176,212 | 1/1993 | Tandberg | 175/333 |
| 5,287,936 | 2/1994 | Grimes et al. | 175/331 |
| 5,332,051 | 7/1994 | Knowlton | 175/430 |
| 5,341,890 | 8/1994 | Cawthorne et al. | 175/374 |
| 5,346,026 | 9/1994 | Pessier et al. | 175/229 |
| 5,351,768 | 10/1994 | Scott et al. | 175/374 |
| 5,351,770 | 10/1994 | Cawthorne et al. | 175/374 |
| 5,379,854 | 1/1995 | Dennis | 175/434 |
| 5,407,022 | 4/1995 | Scott et al. | 175/331 |
| 5,542,485 | 8/1996 | Pessier et al. | 175/374 X |

ROTARY CONE DRILL BIT WITH CONTOURED INSERTS AND COMPACTS

TECHNICAL FIELD OF THE INVENTION

This invention relates in general to the field of rock bits and rotary cone drill bits used in drilling a borehole in the earth, and more particularly to drill bits having cutter cone inserts, surface compacts, and/or support arm inserts with contoured cutting portions that correspond generally to the desired radius for the resulting borehole.

BACKGROUND OF THE INVENTION

One type of drill bit used in forming a borehole in the earth is a rotary cone drill bit. A typical rotary cone drill bit comprises a body with an upper end adapted for connection to a drill string. A plurality of support arms, typically three, depend from the lower end portion of the body. Each support arm includes a spindle protruding radially inward and downward with respect to a projected rotational axis of the body. A cutter cone may be mounted on each spindle and rotatably supported on bearings acting between the spindle and the interior of a cavity formed in the cutter cone. One or more nozzles often are located on the underside of the body adjacent to the arms. These nozzles are generally positioned to direct drilling fluid passing downwardly from the drill string to the bottom of the borehole being formed. The drilling fluid washes away material removed from the bottom of the borehole and cleans the cutter cones carrying the cuttings radially outward and upward within an annulus defined between the bit body and the wall of the borehole. U.S. Pat. No. 5,452,771 entitled "Rotary Drill Bit With Improved Cutter and Seal Protection" and U.S. Pat. No. 5,439,068 entitled "Modular Rotary Drill Bit" show examples of downhole drill bits satisfactory for use with the present invention.

Each cutter cone generally includes a number of inserts and/or milled teeth providing drilling surfaces. It is an advantage for the cutter cones and associated drill bit to provide high penetration rates, resistance to insert or tooth wear and breakage, and maximum tolerance to impact and unit loading. For some downhole applications, compacts are press fitted into the gauge face surface of each cutter cone. These compacts assist with cutting the wall of the borehole as the cutter cone rotates.

The exterior surface of each support arm located adjacent to the respective cutter cone is often referred to as "the shirttail portion" or "shirttail region". The shirttail region is generally relatively thin and often covered with a layer of hard facing material to minimize erosion and wear. Multiple inserts and/or compacts may be included within the hard facing layer or adjacent thereto to further minimize erosion and wear of the shirttail region.

The cutting portion of previously available compacts and inserts often included a flat surface. Some compacts and inserts included a cutting portion having a domed shaped surface with a radius equal to the radius of the respective insert. The cutting portion of previously available inserts and compacts has also included other geometrical configurations such as a flat surface with beveled edges and a cutting portion having both flat surfaces and domed shaped surfaces.

Examples of a rotary cone drill bit having compacts or inserts disposed in the gauge face surface of the cutter cone are described in U.S. Pat. No. 4,056,153; U.S. Pat. No. 5,145,016 and U.S. Pat. No. 5,131,480. U.S. Pat. No. 4,056,153 shows rows of gauge face surface compacts on the cutter cones of a rotary cone drill bit. U.S. Pat. No. 5,145,016 and U.S. Pat. No. 5,131,480 both show bit inserts on the gauge face surface of cutter cones in a rotary cone drill bit. U.S. Pat. No. 5,332,051 shows a diamond rock bit having diamond inserts with a cutting portion having a relatively large convex radius about six times the radius of the associated cylindrical insert body. Each of the preceding patents is incorporated by reference for all purposes within this application.

SUMMARY OF THE INVENTION

In accordance with the present invention, disadvantages and problems associated with previous compacts and inserts for rock bits and rotary cone drill bits have been substantially reduced or eliminated. One aspect of the present invention includes providing a contoured cutting surface on compacts and inserts to substantially enhance erosion, abrasion and/or wear resistance at corresponding locations on a cutter cone and support arm assembly to increase downhole drilling time for the associated drill bit. For one application, a contoured cutting surface is formed with a generally cylindrical configuration with a radius approximately equal to the desired radius for the resulting borehole. For another application, a contoured cutting surface is formed with a domed shaped configuration with a radius approximately equal to the desired radius for the resulting borehole.

One aspect of the present invention includes a rotary cone drill bit with inserts and compacts which eliminate the need for additional grinding or other manufacturing steps to achieve conformance between the inserts and compacts and adjacent portions of the drill bit. Also, forming compacts and inserts in accordance with the teachings of the present invention substantially eliminates or minimizes any void space between the respective compact or insert and adjacent portions of the drill bit. Fabricating compacts and inserts with a cutting portion having a radius approximately equal to the desired radius for the resulting borehole substantially reduces or eliminates any excess material used to fabricate the respective compact or insert.

Technical advantages of the present invention include providing an insert or surface compact to prevent abrasion, wear and/or erosion at corresponding locations on the exterior surface of a drill bit. Forming contoured cutting surfaces in accordance with various teachings of the present invention places more wear-resistant material in contact with adjacent portions of the borehole while at the same time eliminating excess hard material and/or void regions adjacent to the associated compact or insert. Forming a contoured cutting surface in accordance with the teachings of the present invention eliminates the need to grind off or otherwise remove excess material from the respective compact or insert after installation at the desired location in the associated drill bit. Forming contoured cutting surfaces in accordance with the teachings of the present invention reduces both material costs and machine costs to fabricate the associated drill bit. The contoured cutting surface also provides for more uniform loading of the respective compact or insert and substantially eliminates side loading which tends to pull the respective compact or insert out of its opening or socket in the associated support arm or cutter cone.

BRIEF DESCRIPTION OF THE DRAWINGS

A more complete understanding of the present invention may be acquired by referring to the following description taken in conjunction with the accompanying drawings in which like reference numbers indicate like features and wherein.

DETAILED DESCRIPTION OF THE INVENTION

The present invention and its advantages are best understood by referring to FIGS. 1–6 of the drawings, like numerals being used for like and corresponding parts of the drawings.

Figure 1:
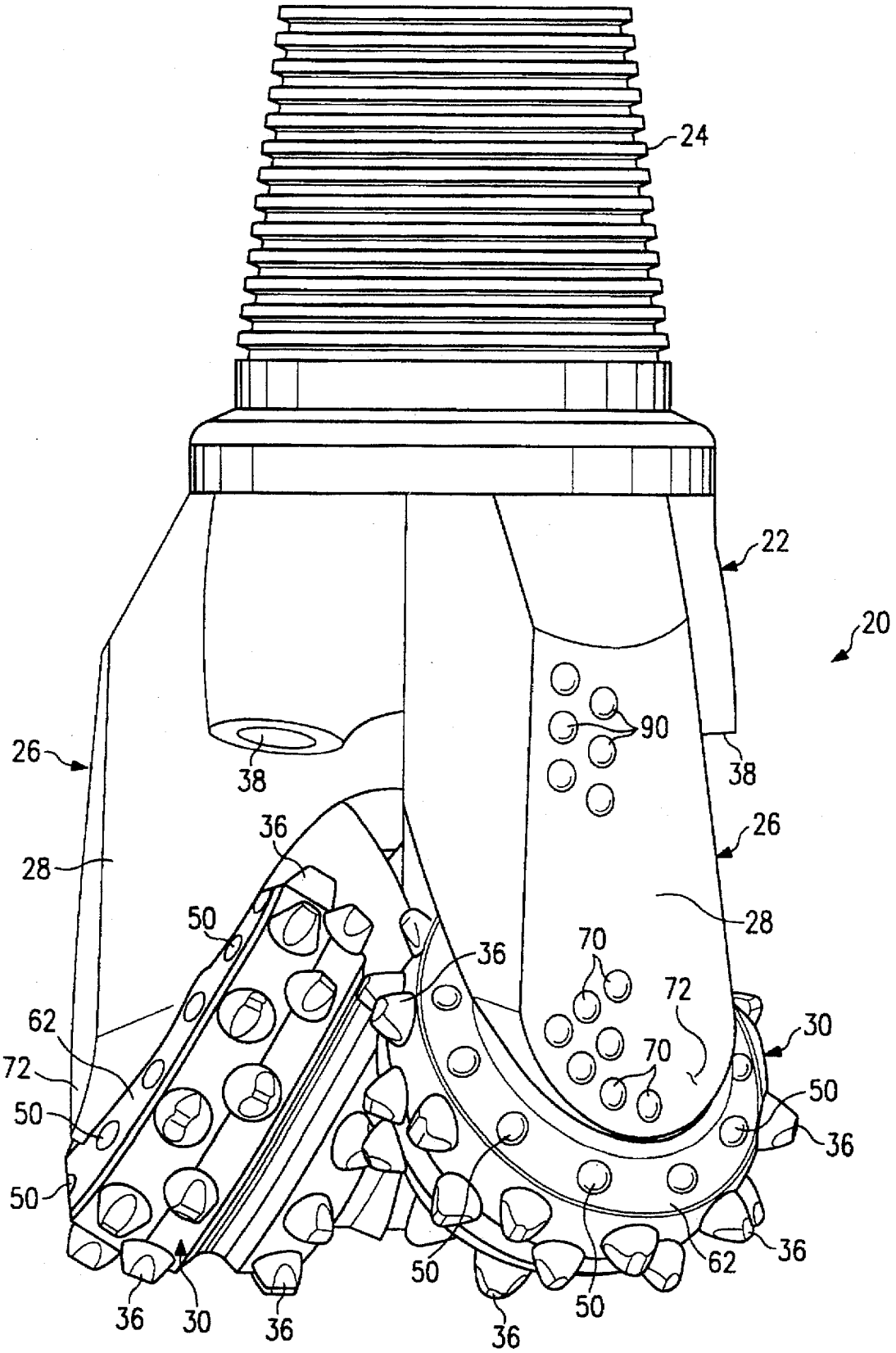
FIG. 1 is schematic drawing showing an isometric view of a rotary cone drill bit constructed according to the teachings of one aspect of the present invention.

FIG. 1 illustrates rotary cone drill bit 20 having surface compacts 50 along with inserts 70 and 90 constructed according to various teachings of the present invention. Rotary cone drill bit 20 forms a borehole by gouging, scraping and/or cutting action of cutter cones 30 as rotary cone drill bit 20 is rolled around the bottom of a borehole by rotation of a drill string attached to rotary cone drill bit 20.

Rotary cone drill bit 20 comprises a bit body 22 having a tapered, externally threaded upper section 24 adapted to be secured to the lower end of a drill string. Rotary cone drill bit 20 includes support arm and cutter cone assemblies 26 which extend downwardly from bit body 22. Each support arm and cutter cone assembly 26 further includes support arm 28 and cutter cone 30.

Each cutter cone 30 includes a number of compacts 50 disposed in gauge face surface 62 of the respective cutter cone 30. For the embodiment shown in FIGS. 1, 2 and 3 each cutter cone 30 also includes a plurality of inserts 36 which gouge and scrape bottom 104 of borehole 100 during rotation of rotary cone drill bit 20. Alternative embodiments of the present invention may include cutter cones that have milled teeth instead of inserts 36. The teachings of the present invention are equally beneficial with respect to such embodiments.

Figure 2:
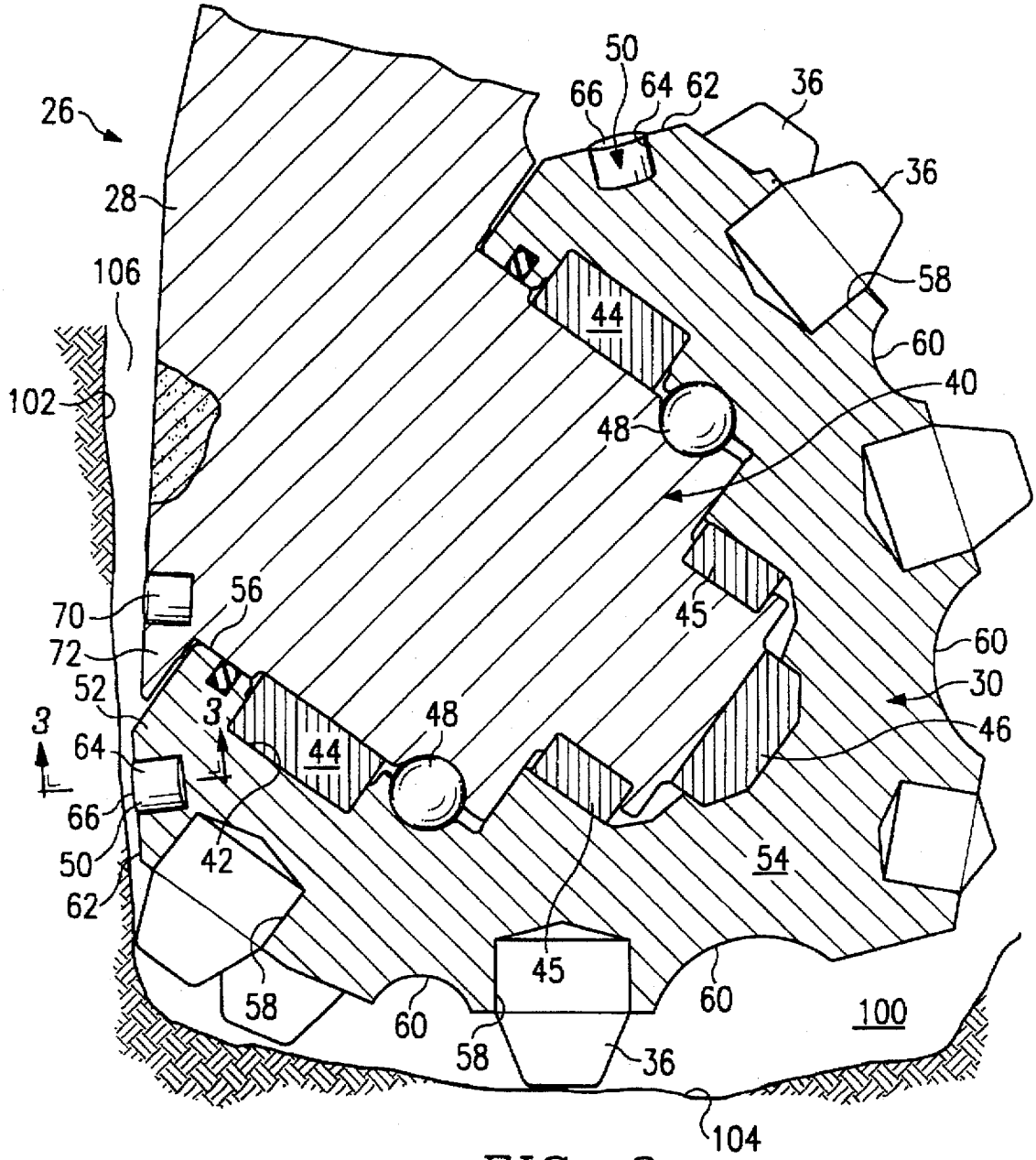
FIG. 2 is a schematic drawing in section with portions broken away of a support arm and cutter cone assembly for the rotary cone drill bit of FIG. 1 engaged with the bottom and sidewall of a borehole.

As shown in FIGS. 1 and 2, rotary cone drill bit 20 operates to scrape and cut or gouge sidewall 102 and bottom 104 of borehole 100 using compacts 50 and inserts 36 as a result of downhole force applied from the drill string. The resulting borehole debris is carried away from bottom 104 of borehole 100 by drilling fluid ejected from nozzles 38 extending from bit body 22. The drilling fluid will generally flow radially outward between the underside of bit body 22 and bottom 104 of borehole 100. The drilling fluid will then flow upward towards the well surface (not shown) through annulus 106 defined in part by the exterior of rotary cone drill bit 20 and sidewall 102 of borehole 100.

FIG. 2 shows a sectional view of one support arm and cutter cone assembly 26 associated with rotary cone drill bit 20 of FIG. 1. Rotary cone drill bit 20 preferably has three support arm and cutter cone assemblies 26 only one of which will be described in detail.

Support arm 28 includes downwardly and inwardly extending spindle 40. Cutter cone 30 includes generally cylindrically shaped cavity 42 which is sized to receive the respective spindle 40 therein. Rotary bearings or bushings 44 and 45 are positioned between the exterior of spindle 40 and the interior of cavity 42 for rotational engagement between cutter cone 30 and the respective spindle 40. Thrust bearing or thrust button 46 may also be positioned within cavity 42 for use in rotatably mounting each cutter cone 30 on its respective spindle 40. Various types of rotary bearings and/or thrust bearings have been previously used in downhole drill bits. The present invention may satisfactorily be used with a wide variety of support arm and cutter cone assemblies having various bearing support systems in addition to rotary bearings 44 and 45 and thrust bearing 46 as shown in FIG. 2.

Cutter cone 30 is retained on its respective spindle 40 by a plurality of ball bearings 48 which are inserted through a ball passage (not shown) in spindle 40. Ball bearings 48 are disposed in an annular array between spindle 40 and an adjacent portion of cavity 42. Once inserted, ball bearings 48 prevent disengagement of cutter cone 30 from its respective spindle 40.

Each cutter cone 30 includes base portion 52 with conically shaped shell or tip 54 extending therefrom. Opening 56 is formed in base 52 with cavity 42 extending therefrom for use in mounting cutter cone 30 on the respective spindle 40. Inserts 36 are disposed in corresponding sockets 58 formed in the exterior of conically shaped shell or tip 54. Various types of inserts and compacts may be used with tip 54, depending upon the intended downhole application for the resulting rotary cone drill bit 20.

Cutter cone 30 as shown in FIG. 2 includes alternating rows of inserts 36 and grooves 60 which cooperate with each other to scrape and gouge bottom 104 of borehole 100. Base portion 52 of cutter cone 30 has a generally frustoconical shape which is angled in a direction opposite from the angle of tip 54. Backface surface or gauge face surface 62 is formed as part of base portion 52. Backface surface 62 is also often referred to as gauge face surface because the inside diameter of the resulting borehole 100 corresponds essentially to the outside diameter defined by the combined dimensions of backface surface or gauge face surface 62 of the three cutter cones 30 which are used to form rotary cone drill bit 20.

Figure 3:
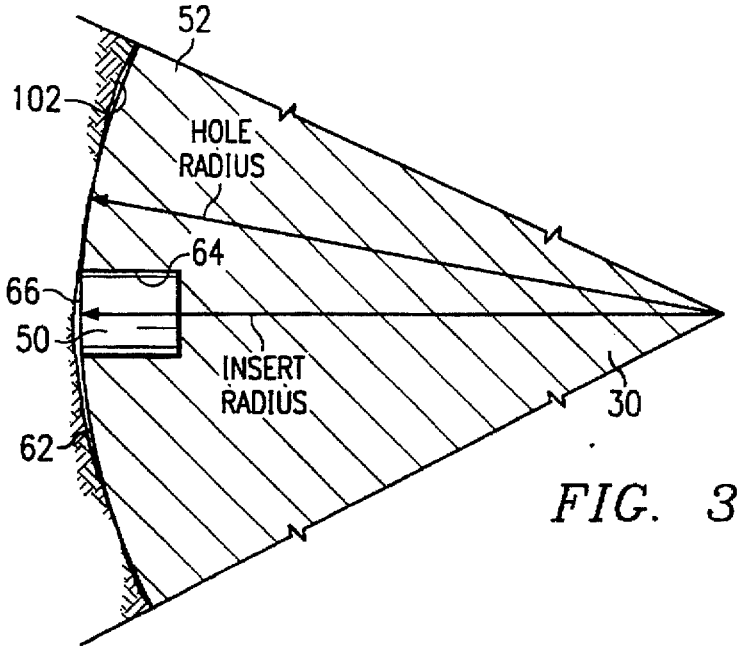
FIG. 3 is an enlarged drawing in section with portions broken away taken along line 3—3 of FIG. 2 taken showing a gauge face surface compact constructed according to teachings of the present invention.

For purposes of illustration, a gap is shown in FIGS. 2 and 3 between gauge face surface 62 and the adjacent portions sidewall 102 of borehole 100. During most downhole drilling operations, gauge face surface 62 will be in close contact with sidewall 102.

A plurality of holes 64 are formed in gauge face surface 62. The dimensions of each hole 64 are selected to accommodate installation by press fitting the respective surface compact 50 therein. Each cutter cone 30 includes a corresponding number of compacts 50 disposed respectively in the plurality of holes 64 formed in each gauge face surface 62. As will be discussed later in more detail, each compact 50 includes contoured cutting portion 66 with a radius which is essentially equal to the desired radius of borehole 100.

Depending upon the downhole drilling environment and particularly for slanted or horizontal wellbores it may be desirable to place one or more inserts within exterior portions of rotary cone drill bit 20 which may come in contact with portions of the wellbore during downhole drilling operations. For example, a plurality of inserts 70 are shown adjacent to the leading edge of support arm 26 as part of shirttail portion 72. A plurality of inserts 90 are also shown adjacent to the leading edge of support arm 28 near the upper portion adjacent to the outlet from nozzles 38. Inserts 70 and 90 are preferably placed adjacent to the leading edge of the respective support arm 28 to minimize erosion, wear and abrasion associated with the combined flow of drilling fluids and borehole debris within annulus 106.

For definitional purposes, the lower, exterior portion of support arm 28 located below nozzles 38 is often referred to as a shirttail surface or simply a shirttail. More specifically, shirttail portion 72 refers to the exterior surface of support arm 28 immediately adjacent to the junction with spindle 40. While drilling with rotary cone drill bit 20, debris will often pass between each gauge face surface 62 and sidewall 102 of borehole 100 within the area which opens into wellbore annulus 106. As a result, the edge of shirttail portion 72 on each support arm 28 which leads in the direction of rotation of drill bit 28 will often become eroded and/or abraded. Installing inserts 70 within shirttail portion 72 will substantially minimize such erosion and/or abrasion.

Inserts 70 and 90 may be substantially identical with each other. Alternatively, inserts 70 and 90 may have both varying geometrical configurations and material compositions depending upon the anticipated downhole drilling environment. One of the benefits of the present invention includes the ability to vary the dimensions such as length and diameter along with the type of materials used to form compacts 50 and inserts 70 and 90 to optimize the downhole performance of the associated rotary cone drill bit.

Figure 4A:
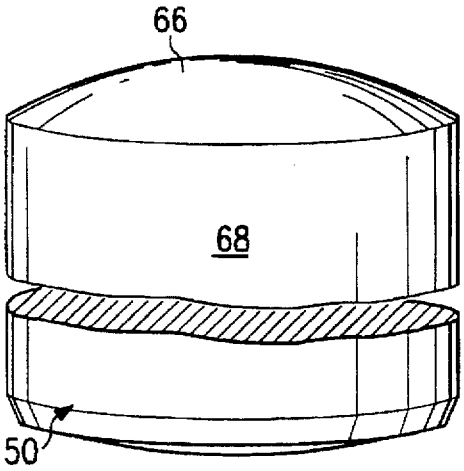
FIG. 4A is an enlarged isometric drawing with portions broken away showing a domed shaped contoured cutting surface formed on an insert in accordance with teachings of one aspect of the present invention.
Figure 5A:
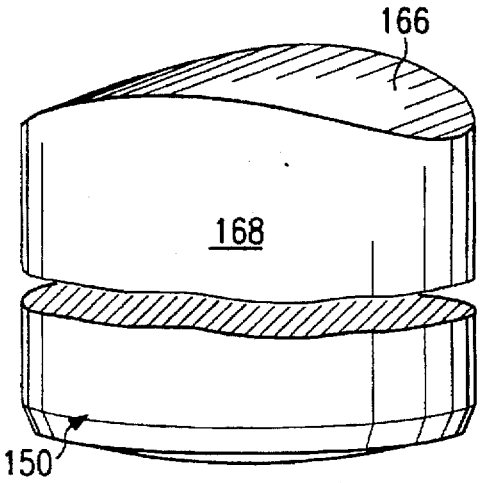
FIG. 5A is an enlarged isometric drawing with portions broken away showing a cylindrical contoured cutting surface formed on an insert in accordance with teachings of another aspect of the present invention.
Figure 4B:
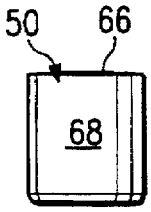
FIG. 4B shows a side view of the insert of FIG. 4A which is more representative of the actual dimensions and configuration of the insert.
Figure 5B:
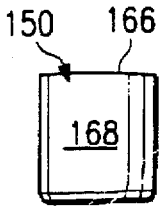
FIG. 5B shows a side view of the insert of FIG. 5A which is more representative of the actual dimensions and configuration of the insert.

For purposes of illustrating some of the alternative embodiments of the present invention, compact 50 as shown in FIGS. 4A and 4B, and compact 150 as shown in FIGS. 5A and 5B, will be discussed in more detail. Inserts 70 and 90 may be provided in accordance with the present invention using the same teachings as described with respect to compacts 50 and 150.

For purposes of illustration compacts 50 and 150 are shown in FIGS. 4A and 4B and 5A and 5B as being constructed from the same material. Depending upon downhole drilling conditions compacts 50 and 150 may have respective body portions 68 and 168 formed from one type of material and respective cutting portions 66 and 166 formed from a different type of material.

For some downhole conditions, compacts 50 and 150, and also inserts 70 and 90, may be formed from tungsten carbide. For purposes of the present application, the term "tungsten carbide" includes monotungsten carbide (WC), ditungsten carbide ($W_2C$), macrocrystalline tungsten carbide and cemented or sintered tungsten carbide. Sintered tungsten carbide is typically made from a mixture of tungsten carbide and cobalt powders by pressing the powdered mixture to form a green compact. Various cobalt alloyed powders may also be included. The green compact is then sintered at temperatures near the melting point of cobalt to form dense sintered tungsten carbide.

Compacts 50 and 150 along with inserts 70 and 90 may be formed from a wide variety of hard materials including various metal alloys and cermets such as metal borides, metal carbides, metal oxides and metal nitrides. An important feature of the present invention includes the ability to select the type of hard material which will provide the desired abrasion, wear and erosion resistance in a cost effective, reliable manner.

Compact 50 includes a domed shaped contoured cutting surface designated as cutting portion 66. Compact 150 includes a contoured cylindrically shaped cutting surface designated as cutting portion 166. The radius of dome portion 66 and the radius of cylindrical portion 166 are both selected to be essentially equal to the desired radius for borehole 100. By forming cutting portions 66 and 166 with this radius, void spaces between the exterior of the respective compacts 50 and 150 and adjacent gauge face surface 62 are substantially reduced or eliminated. Also, since cutting portions 66 and 166 have a radius equal to the desired radius of borehole 100 there is no need for additional machining after installing compact 50 and 150 within their respective opening in gauge face surface 62. Cutting portions 66 and 166 engage sidewall 102 of borehole 100 when rotary cone drill bit 20 is used to form borehole 100.

Body portions 68 and 168 are shown respectively in FIGS. 4A and 4B and 5A and 5B having a generally smooth, cylindrical configuration. For some applications it may be preferable to form a knurled surface (not shown) on the exterior of compacts 50 and/or 150 to enhance the engagement of the respective compact 50 and 150 when press fit into the respective hole 64.

When generally cylindrical, contoured cutting surface 166 is formed on compact 150 and/or inserts 70 and 90, it may be desirable to orient the resulting compact or insert to correspond with the direction of rotation of the associated rotary cone drill bit 20. When domed shaped, contoured cutting surface 66 is used on compact 50 and/or inserts 70 and 90, the resulting compact or insert may be installed without requiring orientation relative to the direction of rotation of the associated rotary cone drill bit 20. Again, one of the benefits of the present invention includes the ability to select a contoured cutting surface which will provide the optimum performance depending upon the anticipated downhole drilling environment.

For some embodiments of the present invention, compacts 50, 150 and inserts 70 and 90 may comprise a body portion and a cutting portion which are both formed from the same type of polycrystalline diamond material. For other embodiments of the present invention compacts 50, 150 and inserts 70 and 90 may comprise body portions constructed from tungsten carbide and cutting portions constructed from polycrystalline diamond material.

Forming cutting portions 66 and 166 with a radius of approximately equal to the desired radius for borehole 100 reduces or minimizes uneven wear of the respective cutting portions 66 and 166. Forming compacts 50, 150 and inserts 70 and 90 with a cutting portion having a radius equal to the desired radius of borehole 100 increases the downhole drilling life of the resulting compact or insert which ultimately increases the downhole drilling time of the associated rotary cone drill bit 20. Also, forming cutting portions 66 and 166 with a radius equal to the desired radius of borehole 100 eliminates the need to form cutting portions 66 and 166 with excess material which is later machined away to provide the desired radius. The cost savings particularly when the cutting portions 66 and 166 are formed from polycrystalline diamond material, can become significant.

The orientation of inserts 70 and 90 may be varied to prevent undesired contact between the exterior of the associated support arm 28 and sidewall 102. Inserts 70 and 90 which are mounted in the exterior of each support arm 28 may or may not impinge upon sidewall 102 of the resulting borehole 100 depending upon drill bit geometry and downhole orientation. Compacts 50 and 150 and inserts 70 and 90 may be staggered or spaced uniformly as appropriate for the downhole drilling environment. Also, the size of each compact 50 and 150 and inserts 70 and 90 and the thickness of the respective contoured cutting portion may be varied as appropriate for the downhole drilling environment.

Figure 6:
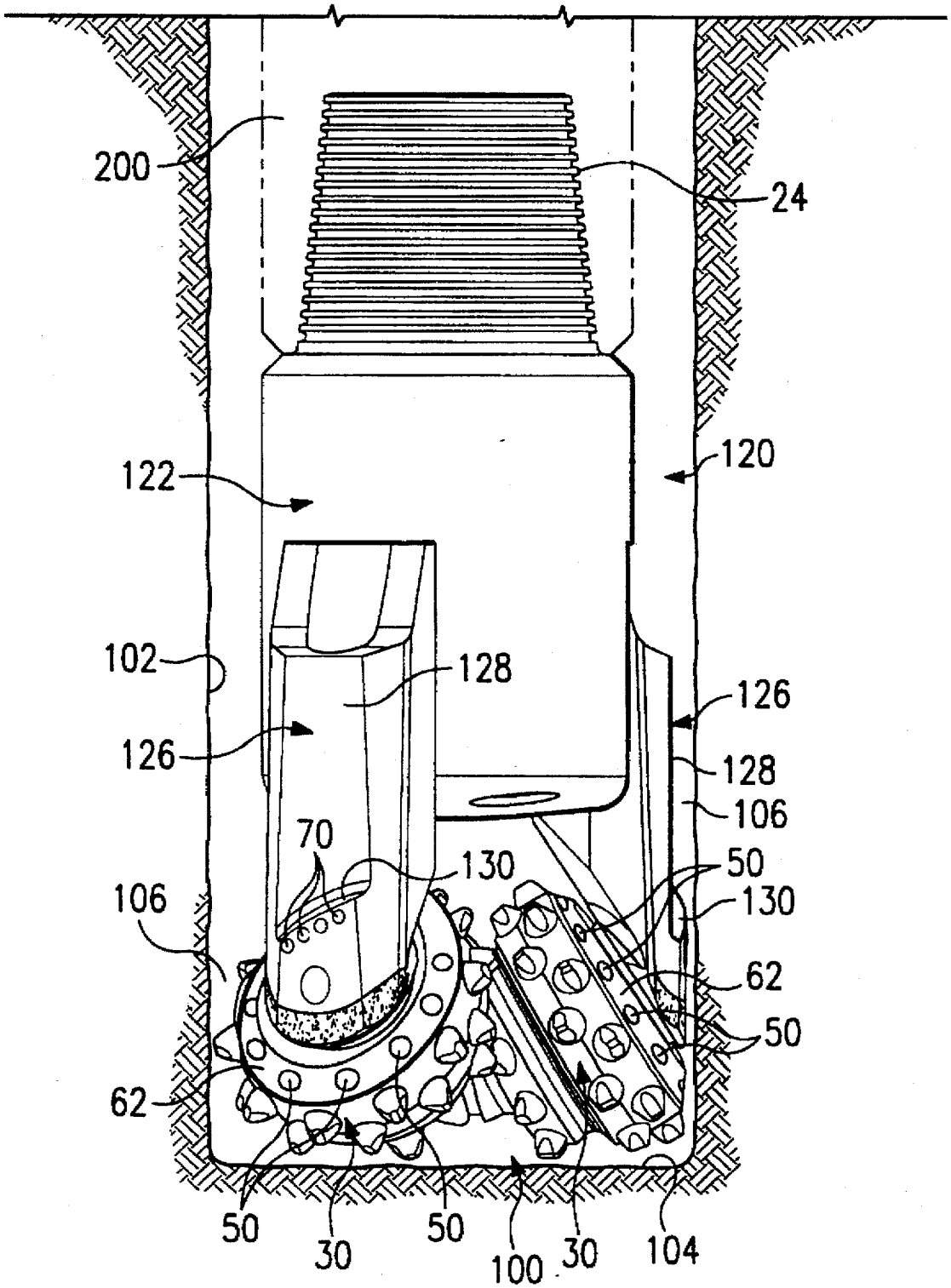
FIG. 6 shows an isometric view of another rotary cone drill bit constructed according to teachings of another aspect of the present invention.

FIG. 6 shows rotary cone drill bit 120 having surface compacts 50 and inserts 70 constructed according to various teachings of the present invention. Rotary cone drill bit 120 comprises bit body 122 having a tapered, externally threaded upper section 24 adapted to be secured to the lower end of drill string 100. Rotary cone drill bit 120 includes three support arm and cutter cone assemblies 126 which extend downwardly from bit body 122. Each support arm and cutter cone assembly 126 includes support arm 128 and cutter cone 30. Rotary cone drill bit 120 may be formed in accordance with the teachings of U.S. Pat. No. 5,439,608 entitled *Modular Rotary Drill Bit*, and U.S. Pat. No. 5,439,067 entitled *Rock Bit with Enhanced Fluid Return Area*.

For some applications the same cutter cone 30 may be used on both drill bit 20 and drill bit 120. The specific type and dimensions for cutter cones 30 will depend upon the downhole drilling environment and the desired inside diameter for the resulting borehole 100. For the embodiment shown in FIG. 6, support arms 128 include ramp 130 which may be used to lift or remove cuttings from the bottom of borehole 100. A plurality of inserts 70 are preferably installed on the exterior of each support arm 128 immediately adjacent to the edge of ramp 130. Inserts 70 thus minimize wear, abrasion and/or erosion of the associated ramp 130. Inserts 70 may be formed essentially the same as previously described with respect to rotary cone drill bit 20.

Technical advantages of the present invention include allowing installing compacts in the gauge face surface of a cutter cone without requiring orientation of the compact within the gauge face surface relative to the direction of rotation of the cutter cone and/or the associated rotary cone drill bit. Further technical advantages of the present invention include forming compacts and inserts with a contoured cutting surface having a radius which is essentially equal to the desired radius of the borehole formed with the associated rotary cone drill bit.

Although the present invention has been described in detail, it should be understood that various changes, substitutions and alterations can be made hereto without departing from the spirit and scope of the invention as defined by the appended claims.

What is claimed is:

1. A rotary cone drill bit for forming a borehole with a desired radius, the drill bit comprising:

a bit body with an upper end portion adapted for connection to a drill string for rotation of the bit body;

a number of angularly spaced support arms formed with the bit body and depending therefrom, each of the support arms having an inside surface with a spindle connecting thereto;

each support arm having a shirttail portion opposite from the respective spindle;

each spindle having a generally cylindrical upper end portion connected to the respective inside surface with the spindle projecting generally downwardly and inwardly therefrom;

a plurality of cutter cones equaling the number of support arms with each cutter cone rotatably mounted on one of the respective spindles;

each of the cutter cones including a generally cylindrical cavity for receiving the respective spindle;

each cutter cone having a gauge face surface with a plurality of holes formed in the respective gauge face surface;

a corresponding number of compacts disposed respectfully in the plurality of holes in each gauge face surface;

each compact having a contoured cutting portion extending from the respective gauge face surface; and each contoured cutting portion having a radius essentially equal to the desired radius of the borehole.

2. The rotary cone drill bit of claim 1 wherein the contoured cutting portion of each compact further comprises a generally cylindrical configuration with a radius which is essentially equal to the desired radius of the borehole.

3. The rotary cone drill bit of claim 1 wherein the contoured cutting portion of each compact further comprises a generally domed shaped configuration having the radius which is essentially equal to the desired radius of the borehole.

4. The rotary cone drill bit of claim 1 further comprising:

a plurality of holes formed in the shirttail portion of each support arm;

a plurality of inserts disposed respectfully in the plurality of holes in the shirttail portion;

each insert having a contoured cutting portion extending from the respective shirttail portion; and each contoured cutting portion having a radius essentially equal to the desired radius of the borehole.

5. The rotary cone drill bit of claim 4 wherein the contoured cutting portion of each insert further comprises a generally cylindrical configuration having the radius which is essentially equal to the desired radius of the borehole.

6. The rotary cone drill bit of claim 4 wherein the contoured cutting portion of each insert further comprises a generally domed shaped configuration having the radius which is essentially equal to the desired radius of the borehole.

7. The rotary cone drill bit of claim 1 wherein each cutter cone further comprises:

a generally conical cutter cone body having a base with an opening to the cavity formed therein and a nose pointed away from the opening to the cavity;

the gauge face surface formed as part of the base of the respective cutter cone body; and the contoured cutting portion of each compact having as generally cylindrical configuration with the radius which is essentially equal to the desired radius of the borehole.

8. The rotary cone drill bit of claim 1 wherein each cutter cone further comprises:

a generally conical cutter body having a base with an opening to the cavity formed therein and a nose pointed away from the opening to the cavity;

the gauge face surface formed as part of the base of the respective cutter cone body; and the contoured cutting portion of each compact having a generally domed shaped configuration with the radius is essentially equal to the desired radius of the borehole.

9. The rotary cone drill bit of claim 1 wherein each compact is formed in part from tungsten carbide alloys.

10. The rotary cone drill bit of claim 1 wherein the contoured cutting portion of each compact is formed in part from polycrystalline diamond.

11. The rotary cone drill bit of claim 4 wherein each insert further comprises alloys of tungsten carbide.

12. The rotary cone drill bit of claim 4 wherein the contoured cutting portion of each insert is formed in part from on polycrystalline diamond.

13. A rotary cone drill bit for forming a borehole with a desired radius, the drill bit comprising:

a bit body with an upper end portion adapted for connection to a drill string for rotation of the bit body;

a number of angularly spaced support arms formed with the bit body and depending therefrom, each of the support arms having an inside surface with a spindle connected thereto;

each spindle having a generally cylindrical upper end portion connected to the respective inside surface with the spindle projecting generally downwardly and inwardly therefrom;

a plurality of cutter cones equaling the number of support arms with each cutter cone rotatably mounted on one of the respective spindles;

each of the cutter cones including an internal generally cylindrical cavity for receiving the respective spindle;

each support arm having a shirttail portion opposite from the respective spindle;

a plurality of holes formed in the shirttail portion of each support arm;

a corresponding number of inserts disposed respectfully in the plurality of holes in the shirttail portion;

each insert having a contoured cutting portion extending from the respective shirttail portion; and each contoured cutting portion having a radius essentially equal to the desired radius of the borehole.

14. The rotary cone drill bit of claim 13 wherein the contoured cutting portion of each insert further comprises a generally cylindrical configuration with a radius which is essentially equal to the desired radius of the borehole.

15. The rotary cone drill bit of claim 13 wherein the contoured cutting portion of each insert further comprises a generally domed shaped configuration with a radius which is essentially equal to the desired radius of the borehole.

16. The rotary cone drill bit of claim 13 wherein each insert is formed in part from tungsten carbide alloys.

17. The rotary cone drill bit of claim 13 wherein the contoured cutting portion of each insert is formed in part from polycrystalline diamond.

18. A rotary cone drill bit for forming a borehole with a desired radius, the drill bit comprising:

a bit body with an upper end portion adapted for connection to a drill string for rotation of the bit body;

a number of angularly spaced support arms formed with the bit body and depending therefrom, each of the support arms having an inside surface with a spindle connecting thereto;

each spindle having a generally cylindrical upper end portion connected to the respective inside surface with the spindle projecting generally downwardly and inwardly therefrom;

a plurality of cutter cones equaling the number of support arms with each cutter cone rotatably mounted on one of the respective spindles;

each of the cutter cones including an internal generally cylindrical cavity for receiving the respective spindle;

each support arm having a shirttail portion opposite from the respective spindle;

an exterior surface formed on each support arm extending upwardly from the respective shirttail portion;

a plurality of holes formed in the exterior surface above the shirttail portion of each support arm;

a corresponding number of inserts disposed respectfully in the plurality of holes in the exterior surface;

each insert having a cutting portion extending from the respective exterior surface; and each cutting portion having a radius essentially equal to the desired radius of the borehole.

19. The rotary cone drill bit of claim 16 wherein the cutting portion of each insert further comprises a generally cylindrical configuration having the radius which is essentially equal to the desired radius of the borehole.

20. The rotary cone drill bit of claim 16 wherein the cutting portion of each insert further comprises a generally domed shaped configuration having the radius which is essentially equal to the desired radius of the borehole.

21. The rotary cone drill bit of claim 16 wherein each insert further comprises alloys of tungsten carbide.

22. The rotary cone drill bit of claim 16 wherein each insert further comprises the cutting portion formed in part from polycrystalline diamond.

* * * * *

UNITED STATES PATENT AND TRADEMARK OFFICE

CERTIFICATE OF CORRECTION

PATENT NO. : 5,709,278

DATED : January 20, 1998

INVENTOR(S) : Crawford

It is certified that error appears in the above-identified patent and that said Letters Patent is hereby corrected as shown below:

Title page, [75], delete "Michael" and insert -- Micheal--.

Signed and Sealed this

Second Day of June, 1998

*Attest:*

*Attesting Officer*

BRUCE LEHMAN

*Commissioner of Patents and Trademarks*